United States Patent [19]

Iijima et al.

[11] 4,316,789

[45] Feb. 23, 1982

[54] CATION EXCHANGE MEMBRANES

[75] Inventors: Tokuzo Iijima, Kobe; Yasushi Samejima, Kakogawa; Kazuo Kishimoto, Takasago; Takamichi Komabashiri, Takasago; Toshiji Kano, Kobe, all of Japan

[73] Assignee: Kanegafuchi Chemical Industry Company Limited, Osaka, Japan

[21] Appl. No.: 150,497

[22] Filed: May 16, 1980

[30] Foreign Application Priority Data

May 16, 1979 [JP] Japan ..... 54-60883

[51] Int. Cl.[3] ..... C25B 13/02; C25B 13/08

[52] U.S. Cl. ..... 204/296; 204/282; 204/283

[58] Field of Search ..... 204/296, 282, 283

[56] References Cited

U.S. PATENT DOCUMENTS

| | | | |
|---|---|---|---|
| 4,024,043 | 5/1977 | Dege et al. | 204/296 |
| 4,083,768 | 4/1978 | Lee et al. | 204/296 |
| 4,100,113 | 7/1978 | McCain | 521/38 |
| 4,168,216 | 9/1979 | Burkhardt et al. | 204/98 |
| 4,169,023 | 9/1979 | Sata et al. | 204/98 |
| 4,183,793 | 1/1980 | Balko et al. | 204/98 |

*Primary Examiner*—F. Edmundson

*Attorney, Agent, or Firm*—Sughrue, Mion, Zinn, Macpeak and Seas

[57] ABSTRACT

A cylindrical cation exchange membrane is described for use in electrolysis of an aqueous alkali metal chloride solution in a finger type electrolytic cell, wherein the equivalent weight of the area not facing the effective electrolytic surface of anode is greater than the equivalent weight of the areas facing the effective electrolytic surface, thus permitting a reduction of the alkali metal chloride content of an effluent from a cathodic chamber.

4 Claims, 10 Drawing Figures

FIG. 1
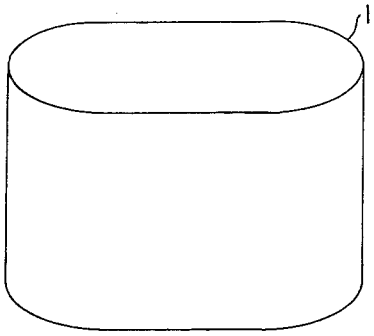
FIG. 2
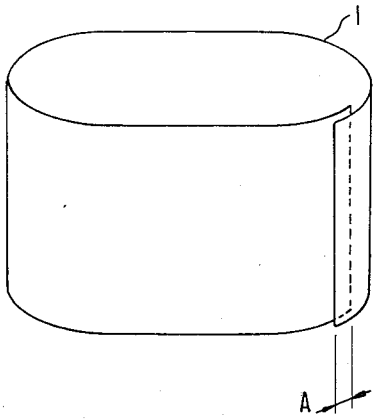
FIG. 3
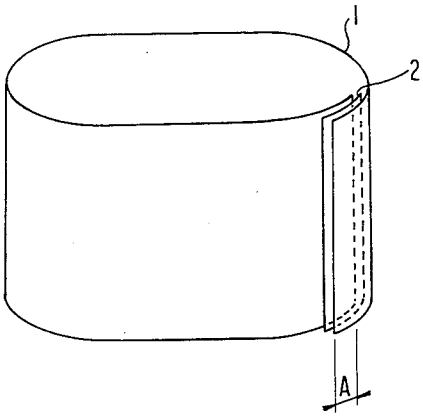
FIG. 4
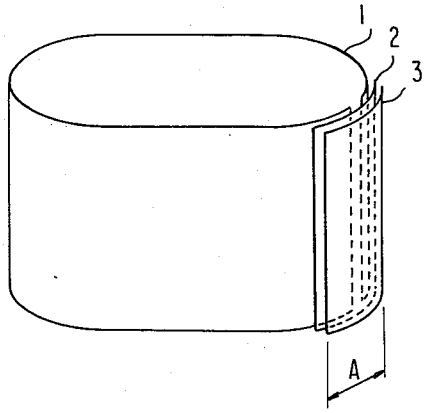
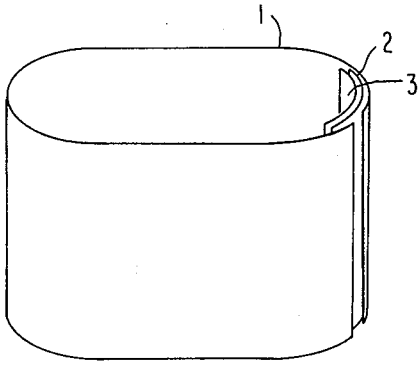
FIG. 5
FIG. 6
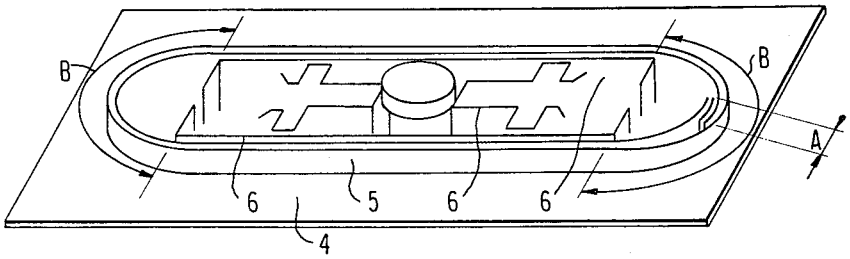

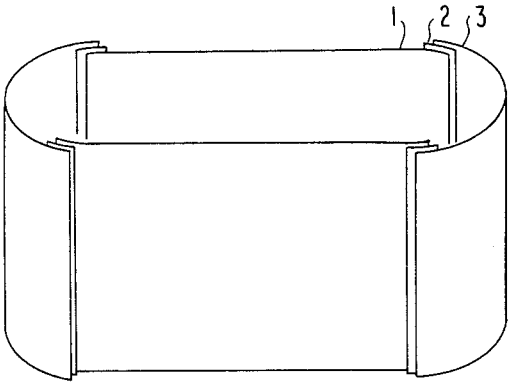
FIG. 7
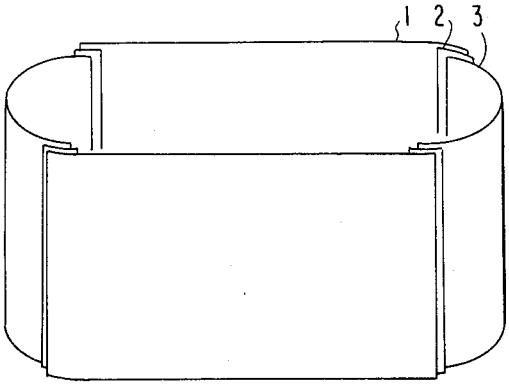
FIG. 9
FIG. 8
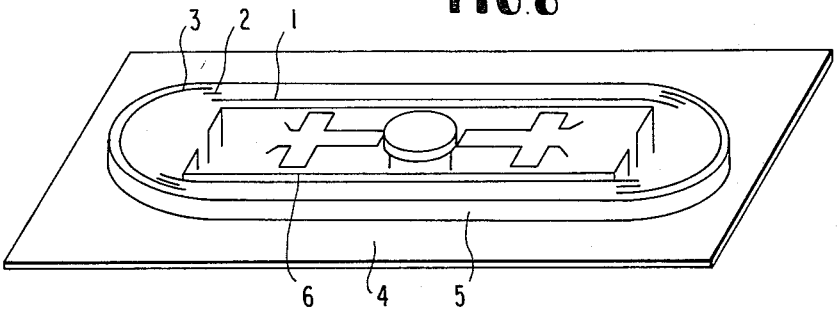
FIG. 10
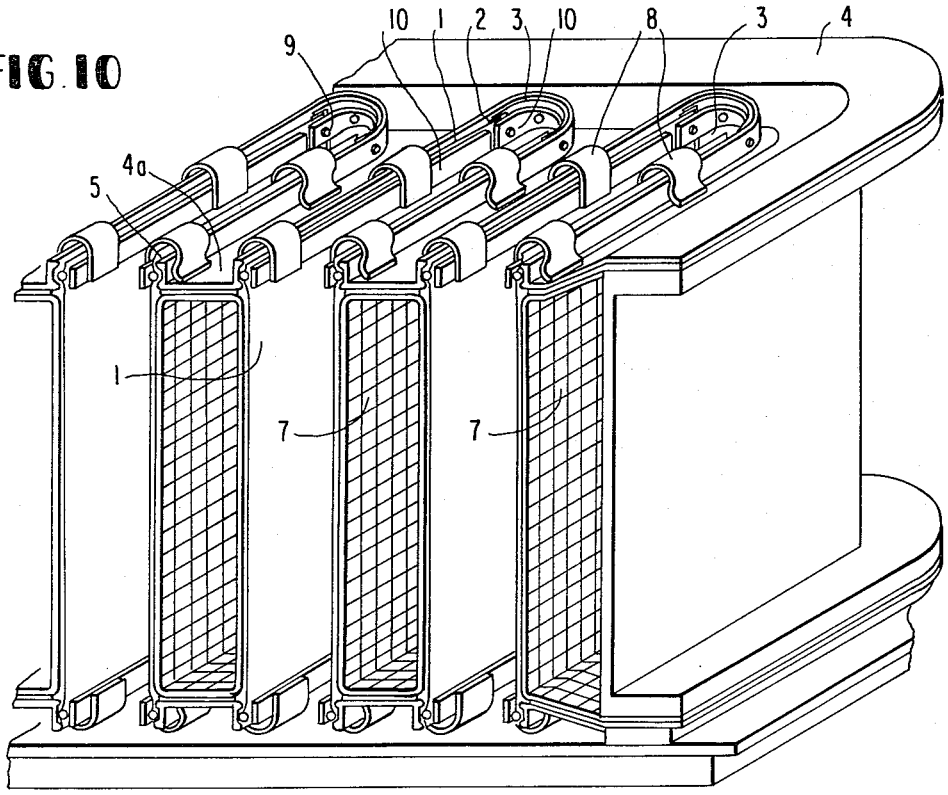

CATION EXCHANGE MEMBRANES

BACKGROUND OF THE INVENTION

1. Field of the Invention

This invention relates to cation exchange membranes, and more particularly to improved cylindrical cation exchange membranes for use in electrolysis of an aqueous alkali metal chloride solution in a finger type electrolytic cell.

2. Description of the Prior Art

The term "finger type electrolytic cell" as used herein includes an electrolytic cell of flattened tube-type construction as well as an electrolytic cell of finger type construction as described in J. S. Sconce, CHLORINE—ITS MANUFACTURE, PROPERTIES AND USES, Reinhold Publishing Corp., New York (1962), page 93.

Cylindrically molded cation exchange membranes are suitable for fitting into finger type electrolytic cells. However, cylindrically molded cation exchange membranes often provide electrolytic products having higher levels of impurities (e.g., alkali metal chloride) than the products obtained from a filter press type electrolytic cell, even if electrolysis is conducted using membranes with the same performance (i.e., the same properties of the membranes) and the same current density One of the reasons for this is that the areas of cathode, membrane and anode are nearly equal to each other in the filter press type electrolytic cell, whereas the area of membrane is larger than that of anode in the finger type electrolytic cell. Since the average current density of the membrane is lower than that of the anode, and low current density areas are present in localized areas of the membrane, and the concentration of alkali metal chloride in the alkali metal hydroxide formed is high.

SUMMARY OF THE INVENTION

This invention is intended to provide improved cylindrical cation exchange membranes which overcome the problems of the prior art membranes.

This invention, therefore, provides a cylindrical cation exchange membrane in which the anion permeability of areas of the membrane not facing the effective electrolytic surface of the anode is lower than the anion permeability of areas facing the effective electrolytic surface of the anode.

BRIEF DESCRIPTION OF THE DRAWINGS

FIGS. 1 to 5 are perspective views of conventional cylindrical membranes.

FIGS. 7 and 9 are perspective views of cation exchange membranes according to this invention.

FIGS. 6 and 8 are illustrative perspective views of a conventional cylindrical membrane and a cation exchange membrane according to this invention, respectively, in combination with the anode.

FIG. 10 is a perspective cross-sectional view of an electrolytic cell having a perpendicular section in which membranes as illustrated in FIG. 7 are fitted.

DETAILED DESCRIPTION OF THE INVENTION

In the cation exchange membranes of this invention, the anion permeability of the areas of the membrane not facing the effective electrolytic surface of the anode is less than the anion permeability of the area facing the effective electrolytic surface of the anode. The expression "effective electrolytic surface" as used herein refers to the area where the current density is high.

In more detail, in the cation exchange membranes of this invention, the weight of dry resin per equivalent of ion exchange group, that is, the equivalent weight of the ion exchange membrane, in the areas not facing the effective electrolytic surface of anode is greater than the weight per equivalent in the areas of the membrane facing the effective electrolytic surface of anode.

One of cation exchange membranes which can be used in this invention is a fluorinated membrane having cation exchange sites, for example, a perfluorosulfonic acid-perfluorocarbon polymer membrane which is produced by E. I. Du Pont Co., under the trademark Nafion.

The perfluorosulfonic acid-perfluorocarbon polymer membrane as used in the examples described below has the structure:

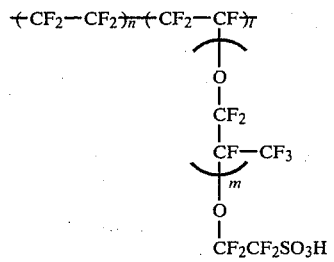

In addition, cation exchange membranes having other weakly acidic exchange sites can be used; for example, such exchange sites may be formed from acidic groups such as carboxylic acid, phosphoric acid, sulfonamido and like, either singly or in admixtures comprising two or more thereof, or in combination with sulfonic acid groups.

For electrolysis at low cell voltages, the equivalent weight of the cation exchange membrane (that is, the concentration of ion exchange sites) at the area facing the effective electrolytic surface of anode is usually from 1,000 g/eq to 1,800 g/eq. Cation exchange membranes are generally non-permeable anions but such anion non-permeability is not complete. In the production of an aqueous alkali metal hydroxide solution by electrolysis of an aqueous alkali metal chloride solution, some alkali metal chloride is contained in the alkali metal hydroxide formed because of incomplete anion non-permeability. Even if cation exchange membranes having good performance are employed, the alkali metal hydroxide concentrated to 50% by weight will typically contain 10 to 100 ppm of alkali metal chloride. These amounts are somewhat higher than the 1 to 60 ppm concentration of alkali metal chloride typically found in alkali metal hydroxide produced by the mercury method.

The use of a cation exchange membrane for use in the finger type electrolytic cell having a high equivalent weight in the areas thereof not facing the effective electrolytic surface of the anode permits the prevention of permeation of anions in those areas of the cylindrical membrane where the current density is low. In the electrolysis of alkali metal chloride, the permeating anion is $Cl^-$. The equivalent weight of the cation exchange membrane is the areas not facing the effective electrolytic surface of the anode should be sufficient to be greater than the equivalent weight (i.e., 1,000 to 1,800 g/eq) of the area facing the effective electrolytic surface, and it is preferably 2,000 g/eq or more.

Methods which can be used for producing cation exchange membranes having equivalent weights of 2,000 g/eq or more include: (1) a method in which sulfonyl groups of a sulfonic acid type cation exchange membrane having an equivalent weight of 1,100 to 1,500 are heated together with sulfonyl chloride to increase the equivalent weight; (2) a method in which radical initiators such as azobisisobutyronitrile act on sulfonyl chloride to increase the equivalent weight; and (3) a method in which a sulfonylchlorinated membrane is hydrolyzed in the presence of acetone to increase the equivalent weight.

Conventional cylindrical membranes are illustrated in FIGS. 1 to 5. FIG. 1 shows a cation exchange membrane molded in a cylindrical form by extrusion molding. FIG. 2 shows a cylindrical membrane produced by bonding a cation exchange membrane 1. FIG. 3 shows a cylindrical membrane produced by bonding a cation exchange membrane 1 with a perforated hydrophilic fluorinated polymer 2 interposed between overlapping portions. FIGS. 4 and 5 show cylindrical membranes produced by use of a piece of a cation exchange membrane 3 as a patch to bind the ends of the cation exchange membrane 1 with a perforated hydrophilic fluorinated polymer 2 interposed therebetween.

Regarding the perforated fluorinated polymers, membranes thereof containing sulfonic acid or sulfonamido groups can be used. These membranes have sulfonic acid or sulfonamido groups on at least one side thereof, and prior to the use thereof, the sulfonic acid or sulfonamido groups are converted to ammonium salts with tertiary amine salts, quaternary ammonium bases or their salts. Examples of such perforated fluorinated polymer membranes having sulfonic acid or sulfonamido groups include Nafion #701, #710, etc., produced by E. I. Du Pont Co. Such a membrane can be treated by the method described in Japanese patent application No. 49394/79 and thereafter it is interposed between two fluorinated polymer materials in a sandwiched structure and mounted. Heat adhesion is carried at a temperature of from about 150° C. to 300° C. and pressure of from about 10 kg/cm$^2$ to 150 kg/cm$^2$.

Useful perforated fluorinated polymers include, in addition to perforated membranes containing cation exchange groups, homo- and copolymers of tetrafluoroethylene, trifluoropropylene and perfluoroalkyl vinyl ether, polyethylene trifluorochloride, polyvinylidene fluoride and the like.

For making these perforated fluorinated polymers hydrophilic, a corona discharge method or a method using active sodium, e.g., sodium metal, sodium dispersion or stabilized sodium metal, can be employed. Also, these fluorinated polymers can be made hydrophilic by surface active agents, such as fluorine-based surface active agents. In addition, these fluorinated polymers can be made hydrophilic by use of titanium compounds, such as potassium titanate and titanium dioxide.

A cylindrical membrane of the type as illustrated in FIG. 3 can be mounted in a frame 4 for attachment of the cation exchange membrane as illustrated in FIG. 6. For such a conventional cylindrical membrane, the length (A) of the bonded portion is shorter than the length (B) of the areas of collar part 5 not facing the effective electrolytic surface of the anode. Therefore, in an area corresponding to the length of 2B−A, the resistance to anion permeability is not sufficient. Typically A is less than $\frac{1}{3}$ of B.

An embodiment of a cylindrical membrane according to this invention is illustrated in FIG. 7, wherein 1 is a cation exchange membrane, 2 is a perforated hydrophilic fluorinated polymer, and 3 is a cation exchange membrane having a lower anion permeability than the cation exchange membrane 1. The material constituting the cation exchange membrane 3 may be the same as or different from that of the cation exchange membrane 1. For example, the cation exchange membrane 1 can be a carboxylic acid type cation exchange membrane while the cation exchange membrane 3 is a sulfonic acid type cation exchange membrane.

The cylindrical membrane of FIG. 7 can be mounted as illustrated in FIG. 8, wherein 4 is a frame for attachment of the cation exchange membrane which is placed on the surface of the cathode, 5 is a collar portion of frame 4, and 6 is an anode.

A membrane as illustrated in FIG. 9 wherein anodic sides of a cation exchange membrane 1 are connected can preferably be used.

FIG. 10 is a perspective cross-sectional view of an electrolytic cell in which membranes having the shape as illustrated in FIG. 7 are mounted. In FIG. 10, 1 is a cation exchange membrane, 2 is the perforated hydrophilic fluorinated polymer, 3 is the cation exchange membrane having a lower anion permeability, 4, a frame for attachment of cation exchange membrane, 4*a*, a horizontal part of the frame 4, 5, a collar part of the frame 4, 7, cathode, 8, a clip, 9, a bolt and a nut, and 10, a support plate.

The following examples and comparative examples illustrate this invention in greater detail, but this invention is not limited thereby. Unless otherwise indicated herein, all parts, percents, ratios and the like are by weight.

EXAMPLE 1

Referring to the numerical designations of FIG. 7, a sulfonic acid type cation exchange membrane, using Nafion #315 and Nafion #701 (both produced by E. I. Du Pont Co.) as the cation exchange membrane 1 and the perforated hydrophilic fluorinated polymer 2, respectively, was employed.

The cation exchange membrane 3 was produced as follows:

A sulfonic acid type cation exchange membrane, viz, Nafion #315, was dipped in a 10% aqueous solution of allylamine for 2 hours and after being dried, reacted at 120° C. for 10 hours in a phosphorous pentachloride-phosphorous oxychloride (1:1) mixture to give a sulfonyl chloride type membrane. This sulfonyl chloride type membrane was impregnated with acetone and then hydrolyzed at 80° C. for 16 hours in a 10 N caustic methanol/water (1/1 by weight) solution. The equivalent weight of the membrane thus obtained was 2,500.

By using the cation exchange membrane 1, the perforated hydrophilic fluorinated polymer 2, and the cation exchange membrane 3, a cylindrical membrane having the shape as illustrated in FIG. 7 was produced by hot pressing. Prior to the hot pressing, the areas to be hot pressed were dipped in a 50% MeOH aqueous solution containing 0.2 mol/l of ammonium tetrabutyl hydroxide for 1 hour to convert the exchange group to ammonium salts. This was followed by hot pressing at 250° C. and 75 kg/cm$^2$ for 5 minutes.

The thus obtained cylindrical membrane was mounted in a titanium frame 4 for attachment of cation exchange membrane. A finger type electrolytic cell of a current area of 85.1 $dm^2$ with Expandable DSE (i.e., Dimensionally Stable Electrode) as the anode and a perforated metal as cathode was employed.

3 N brine (i.e., an alkali metal chloride solution) was supplied to an anodic chamber, while 2 N brine was withdrawn therefrom to control the concentration of caustic soda in the cathodic chamber at 20% by weight. A current was passed to give a current density of 25 $A/dm^2$. The temperature of the electrolytic cell was 88° C. and the cell voltage was 3.52 V.

The concentration of caustic soda in the effluent from the cathodic chamber was 20.1% by weight and the concentration of sodium chloride was 34 ppm. Calculated on a basis corresponding to a concentration of caustic soda of 50% by weight, the concentration of sodium chloride would be 85 ppm.

EXAMPLE 2

A sulfonic acid type cation exchange membrane, Nafion #417, produced by E. I. Du Pont Co. was employed as a cation exchange membrane, and one surface thereof was processed in the same manner as in Example 1 to provide a 15$\mu$ thick sulfonyl chloride type layer thereon.

This membrane was dipped in a 4-bromo-1,1,2-trifluoro-butene-1 solution saturated with azobisisobutyronitrile and reacted for 20 hours at 75° C. Thereafter, it was hydrolyzed by dipping it in a 20% sodium hydroxide solution of a 1:1 mixture of water:methanol at 80° C. for 16 hours, and it was then oxidized by dipping in an aqueous 20% sodium hydroxide solution saturated with potassium permanganate at 80° C. for 16 hours. Surface infrared (Attenuated Total Reflection) analysis of the treated surface showed a large peak attributable to the fluorine-based carboxylic acid group at 1,780 $cm^{-1}$. The thickness of the carboxylic acid type cation exchange layer was 15$\mu$.

A cylindrical membrane having the shape as illustrated in FIG. 9 was produced in the same manner as in Example 1, except that the membrane having the carboxylic acid layer on one surface thereof was placed in such a manner that the carboxylic acid layer faced the cathode. This cylindrical membrane was mounted in a frame for attachment of the cation exchange membrane in the same manner as in Example 1.

An aqueous 5 N sodium chloride solution was supplied to an electrolytic cell and electrolyzed at an anodic current density of 25 $A/dm^2$. The temperature of the anodic chamber was 89° C. and the cell voltage was 3.58 V.

The concentration of caustic soda in the effluent from the cathodic chamber was 29.8% and the concentration of sodium chloride was 27 ppm. Calculated on a basis corresponding to a concentration of caustic soda of 50%, the concentration of sodium chloride would be 45 ppm.

COMPARATIVE EXAMPLE 1

By using Nafion #315 and #701 as used in Example 1, a cylindrical membrane having the shape as illustrated in FIG. 3 was produced. By use of this cylindrical membrane, a sodium chloride aqueous solution was electrolyzed in the same manner as in Example 1. The equivalent weight of the area corresponding to B of FIG. 6 was 1,500 g/eq.

The temperature of the anodic chamber was 87° C. and the cell voltage was 3.48 V.

The concentration of caustic soda in the effluent from the cathodic chamber was 19.2% and the concentration of sodium chloride was 49 ppm. Calculated on a basis corresponding to a concentration of caustic soda of 50%, the concentration of sodium chloride would be 128 ppm.

COMPARATIVE EXAMPLE 2

A cylindrical membrane having the shape as illustrated in FIG. 5 was produced, wherein 1 was the same carboxylic acid type membrane as used in Example 2, 2 was Nafion #701, and 3 was Nafion #315. By use of this cylindrical membrane, a sodium chloride aqueous solution was electrolyzed in the same manner as in Example 2.

The temperature of the anodic chamber was 89° C. and the cell voltage was 3.54 V.

The concentration of caustic soda in the effluent from the cathodic chamber was 30.1% and the concentration of sodium chloride was 51 ppm. Calculated on a basis corresponding to a concentration of caustic soda of 50%, the concentration of sodium chloride would be 85 ppm.

While the invention has been described in detail and with reference to specific embodiments thereof, it will be apparent to one skilled in the art that various changes and modifications can be made therein without departing from the spirit and scope thereof.

What is claimed is:

1. A cylindrical cation exchange membrane, by which a finger type electrolytic cell is separated into an anode compartment providing anodes and a cathode compartment providing cathodes, said membrane comprising:

first portions facing effective electrolytic surface of said cathodes and anodes having an equivalent weight of from 1,000 g/eq to 1,800 g/eq; and second portions facing ineffective electrolytic surface of said anodes and cathodes having an equivalent weight of 2,000 g/eq or more.

2. A cylindrical cation exchange membrane as in claim 1, wherein the portions of said membrane facing the effective electrolytic surface of the anode are a carboxylic acid type cation exchange membrane.

3. A cylindrical cation exchange membrane as in claim 2, wherein the portions of the membrane facing the ineffective electrolytic surface of the anode comprise a sulfonic acid type cation exchange membrane.

4. A cylindrical cation exchange membrane as in claim 1, wherein the portions of said membrane facing the effective electrolytic surface of the anode are a sulfonic acid type cation exchange membrane.

* * * * *